US006345800B1

(12) United States Patent
Herst et al.

(10) Patent No.: US 6,345,800 B1
(45) Date of Patent: Feb. 12, 2002

(54) UNIVERSAL LOAD-BEARING HANGER BRACKET AND METHOD FOR HANGING A LIGHTING FIXTURE BELOW A GRID CEILING SYSTEM AT ON-GRID OR OFF-GRID LOCATIONS

(75) Inventors: Douglas J. Herst, Ross; Michael Tran, Oakland, both of CA (US)

(73) Assignee: NSI Enterprises, Inc., Atlanta, GA (US)

( * ) Notice: Subject to any disclaimer, the term of this patent is extended or adjusted under 35 U.S.C. 154(b) by 0 days.

(21) Appl. No.: 09/362,640

(22) Filed: Jul. 27, 1999

Related U.S. Application Data

(60) Provisional application No. 60/094,328, filed on Jul. 27, 1998.

(51) Int. Cl.[7] ..... A47H 1/10

(52) U.S. Cl. ..... 248/342; 248/343; 248/906

(58) Field of Search ..... 248/342, 343, 248/345, 316.1, 316.4, 302, 303, 214, 218.1, 229.12, 224.7, 229.15, 229.25, 906

(56) References Cited

U.S. PATENT DOCUMENTS 2,578,022 A * 12/1951 Schoenbrod ..... 248/343 X
2,661,924 A * 12/1953 Wilt ..... 248/345
3,780,973 A * 12/1973 Dalton, Jr. ..... 248/343 X
4,041,657 A * 8/1977 Schuplin ..... 248/343 X
4,149,693 A * 4/1979 LoNigro ..... 248/343 X
5,341,276 A * 8/1994 Shen ..... 248/343 X
5,434,356 A * 7/1995 Zekowski ..... 248/343 X
5,435,514 A * 7/1995 Kerr, Jr. ..... 248/343
5,484,076 A * 1/1996 Petrushka ..... 248/343 X
5,515,252 A * 5/1996 Osteen et al. ..... 248/343 X
5,560,101 A * 10/1996 Sandell et al. ..... 248/343 X
5,957,574 A * 9/1999 Hentz et al. ..... 248/343 X

* cited by examiner

*Primary Examiner*—Ramon O. Ramirez
*Assistant Examiner*—A. Joseph Wujciak
(74) *Attorney, Agent, or Firm*—Donald L. Beeson

(57) ABSTRACT

A universal load-bearing hanger bracket for hanging a lighting fixture below a grid ceiling has opposed shaped hanger strips which when joined together form an elongated bracket body having a base end with a T-bar channel for securing the hanger bracket to the T-bar of the grid ceiling to thus provide an "on-grid" suspension, and a rail gripping structure above the T-bar channel for securing the hanger bracket to an optional mounting rail of a grid ceiling for an "off-grid" suspension. A hanger bracket assembly is further described wherein an electrical junction box is secured to the body of the hanger bracket and wherein a female plug having a downwardly facing plug end is provided at the bottom wall of the junction box so as to extend through the grid ceiling to provide an accessible electrical outlet next to the suspension location for the lighting fixture.

18 Claims, 17 Drawing Sheets

UNIVERSAL LOAD-BEARING HANGER BRACKET AND METHOD FOR HANGING A LIGHTING FIXTURE BELOW A GRID CEILING SYSTEM AT ON-GRID OR OFF-GRID LOCATIONS

CROSS-REFERENCE TO RELATED APPLICATIONS

This application claims the benefit of U.S. Provisional Application No. 60/094,328 filed Jul. 27, 1998.

BACKGROUND OF THE INVENTION

The present invention generally relates to the installation of architectural lighting fixtures, and more particularly to the suspension of lighting fixtures below a grid ceiling system and to providing an optional electrical feed at a point of suspension.

Heretofore, lighting fixtures have been supported below grid ceilings using cumbersome support hardware that is relatively difficult and costly to install. Prior methods of support involve, for example, the use of separate support members such as angle irons or unistruts which are cut to a required length at the job site. These support members are positioned on top of or above the grid ceiling at specified fixture support locations, and then they are anchored to the building superstructure by overhead load wires. (In earthquake prone areas the load wires must, in addition to supporting a vertical load, provide lateral support.) Wherever an electrical feed is required, an electrical junction box must be installed along with the anchored support member. For this purpose, commercially available mounting rails that fasten to the T-bars of the grid ceiling system are commonly used. Mounting rails installed across individual squares of the ceiling's T-bar grid structure permit the junction box to easily be located within selected grids. Sometimes a load wire is dropped directly to the mounting rail and attached by means of a wire clip, however, without independent support the load carrying capacity of such an arrangement is limited.

U.S. Pat. No. 5,484,076 to Stephen Petrushka discloses a load-bearing mounting bracket and bracket assembly used with conventional mounting rails that greatly simplifies the process of installing lighting fixtures below grid ceilings as compared to the conventional installation approaches above-described. In the Petrushka patent a saddle-shaped load-bearing mounting bracket straddles and is adjustable along the mounting rail and permits easy and secure attachment of overhead load wires to the point of suspension of the lighting fixture. The Petrushka mounting bracket can also optionally be used with an electrical junction box to permit its use at electrical feed locations as well as non-feed locations. Thus, the same mounting hardware can be used cost effectively in a variety of different installation environments to meet different installation requirements.

However, the Petrushka mounting bracket has a notable limitation: the only structure to which it can be mounted is an accessory mounting rail of the grid ceiling system. This means the bracket is limited to off-grid suspensions, that is, to suspension locations between the T-bar members of the ceiling's T-grid; where a desired suspension point falls directly on a T-bar (an on-grid suspension point) different hanging hardware must be used. The need or potential need for additional hardware increases stocking requirements and the risk that needed hardware will not be readily available at the job site when the fixtures are hung, resulting in lost time and increased labor costs.

The present invention overcomes the limitations of the Petrushka mounting bracket by providing a hanger bracket, hanger bracket assembly and method for hanging a lighting fixture from off-grid or on-grid suspension locations using the same hanging hardware, thus eliminating the need for more than one type of hanging or mounting hardware for a particular job site. The invention provides a hanger bracket that is inexpensive to manufacture and that readily and adjustably attaches to either the ceiling's T-bars or its accessory mounting rails.

The present invention also permits suspension of a lighting fixture below a grid ceiling at an electrical feed point, and addresses the labor inefficiencies of having to wire the fixture directly to an electrical junction box above the ceiling. Typically, once lighting fixtures have been hung from a grid ceiling structure, an electrical contractor must be called back to wire the fixtures at a relatively high labor charge, adding significantly to cost of the installation. Also, if the fixtures are moved, for example, to accommodate a reconfiguration of open office furniture systems, rewiring is normally required which again requires an electrician. An aesthetically pleasing installation also requires that the electrical feed be unobtrusive as possible. To accomplish this, the fixture power cord is run up to the ceiling as close to the fixture's suspension cable as possible and fed through a ceiling canopy which covers the hanging hardware and holes cut in the ceiling tiles to accommodate the hanging hardware and wires.

The present invention provides a means for hanging or moving architectural lighting fixtures in an architectural space in a manner that permits electrical feeds to be simply plugged in at the ceiling in a manner that maintains the aesthetics of the installation. Electrical feeds can thus be provided by the installer of the fixture without the need of an electrician or electrical contractor, other than to provide the initial wiring to preselected electrical feed locations.

SUMMARY OF THE INVENTION

Briefly, the invention provides for a load-bearing hanger bracket for suspending a lighting fixture from on-grid and off-grid locations within a grid ceiling system. The hanger bracket is comprised of an elongated bracket body having a base end, a top end, and at least one load bearing wire attachment point. A first attachment structure is provided at the base end of the bracket body for attaching the hanger bracket to a T-bar member of a grid ceiling at a selected location along the T-bar, while a second attachment structure is provided for optionally mounting to an accessory mounting rail connected between opposed T-bars at a selected location along the mounting rail. By providing dual attachment structures, the hanger bracket can be used to hang lighting fixtures from a T-bar of a grid ceiling system or from a mounting rail between T-bar members depending on where in the grid ceiling system the fixtures are to be located.

In a further aspect of the invention, an electrical junction box is provided with the hanger bracket to provide a hanger bracket assembly having an electrical feed next to the fixture's suspension point. In the preferred embodiment, a female plug is provided in the bottom wall of an electrical junction box so as to provide an electrical outlet at the ceiling. A ceiling canopy, which covers the hanger bracket and electrical outlet, is provided with an opening through which a male plug, provided at the end of a lighting fixture power cord, can be inserted. Using the hanger bracket assembly of the invention, a lighting fixture can easily be installed with an electrical feed and with a clean, architecturally pleasing interface at the ceiling surface.

In still another aspect of the invention, a method is provided for electrically connecting lighting fixtures suspended below a drop ceiling, such as a grid ceiling system. The method includes providing electrical outlets at preselected lighting fixture suspension locations above the drop ceiling wherein each of the electrical outlets has a female plug having a downwardly facing plug end extending to the drop ceiling next to a suspension location for the lighting fixtures. The method further includes wiring the electrical outlets so as to electrify same, and hanging lighting fixtures from the drop ceiling having power cords with a male plug end of sufficient length to reach the ceiling. After the fixtures are hung, their power cords are simply plugged into the female plugs of the pre-wired electrical outlets above the drop ceiling next to the suspension location of the fixtures. The ceiling can be provided with an array of prewired electrical outlets which can be used to install lighting fixtures at preset locations or to move lighting fixtures from one preset location to another.

Therefore, it can be seen that it is a primary object of the invention to facilitate the hanging of electric lighting fixtures below grid ceiling systems. It is a further object of the invention to reduce the hanging hardware necessary to hang lighting fixtures from various locations within the grid ceiling system. It is still another object of the invention to reduce labor costs for lighting fixture installations. It is yet a further object of the invention to facilitate the moving of lighting fixtures from one location to another beneath a drop ceiling, by eliminating the need for rewiring. Yet other objects of the invention will be apparent from the following specification in claims.

DETAILED DESCRIPTION OF THE ILLUSTRATED EMBODIMENT

Figure 1:
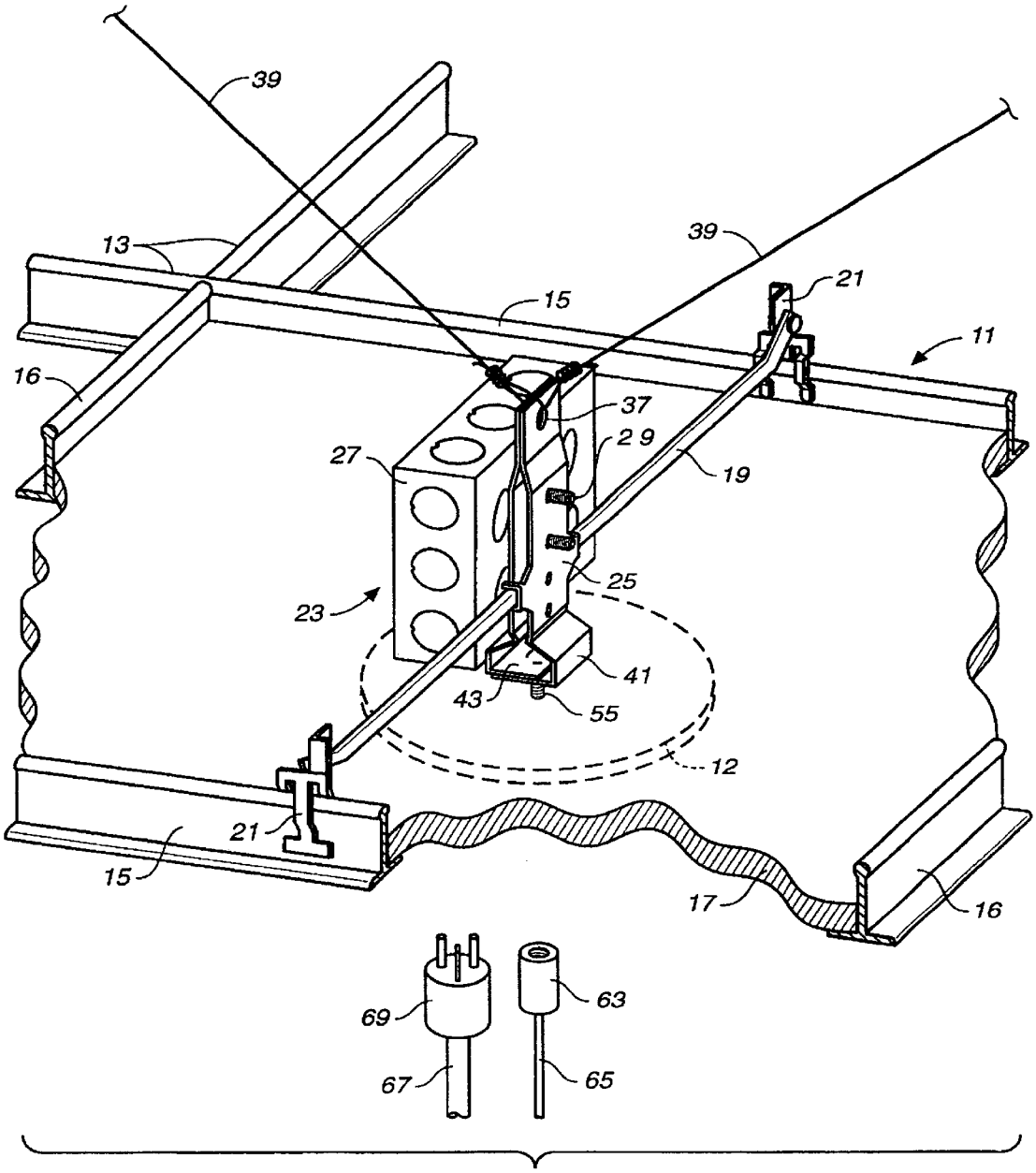
FIG. 1 is a top perspective view of a grid ceiling system and a hanger bracket assembly in accordance with the invention secured to a mounting rail of the grid ceiling for positioning the hanger bracket assembly at an off-grid location.
Figure 1A:
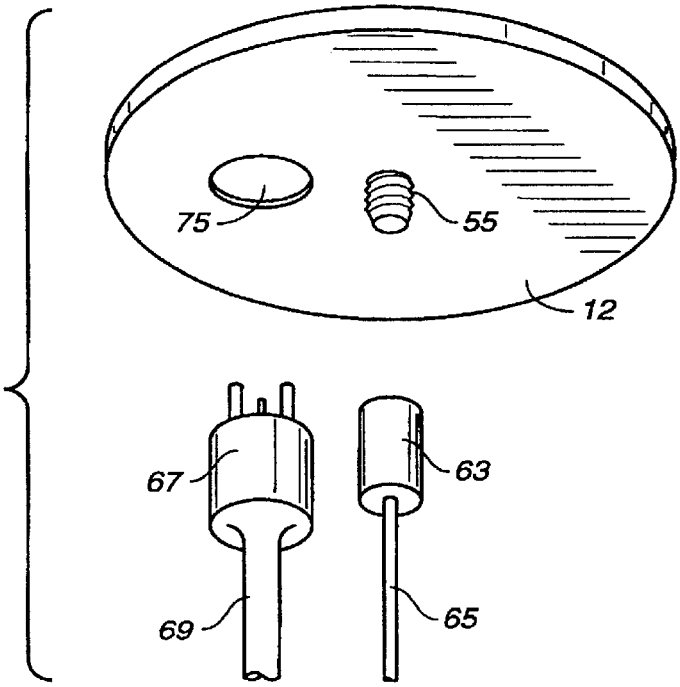
FIG. 1A is a bottom perspective view of the canopy of the hanger bracket assembly which is placed against the bottom surface of the grid ceiling tile as shown in phantom lines in FIG. 1, and further showing how the ends of the suspension cable and power cord of the lighting fixture suspended from the hanger bracket assembly are connected at the canopy.

Referring now to the drawings, FIG. 1 shows a portion of a conventional grid ceiling system 11 having a T-bar grid 13 formed by connected T-bar members 15, 16 which hangs from the structural ceiling (not shown) of a room by suitably spaced drop wires (also not shown). The T-bar grid supports square ceiling tiles, such as ceiling tile 17, to form a drop ceiling within the room at a desired height from the floor. FIG. 1 also shows an optional mounting rail 19 attached between parallel T-bar members 15 by means of mounting clips 21 which secure the ends of the mounting rail to the T-bar members. The mounting rails and clip fasteners are standard, commercially available accessories for grid ceiling systems which permit the suspension of lighting fixtures and electrical feeds at off-grid locations, that is, at locations between the T-bar members of the T-bar grid. The present invention provides a universal hanger bracket and hanger bracket assembly that can alternatively be used to suspend a lighting fixture from an accessory mounting rail 19 of a grid ceiling system (an off-grid suspension) or from the grid ceiling's T-bar members themselves (an on-grid suspension).

Figure 2A:
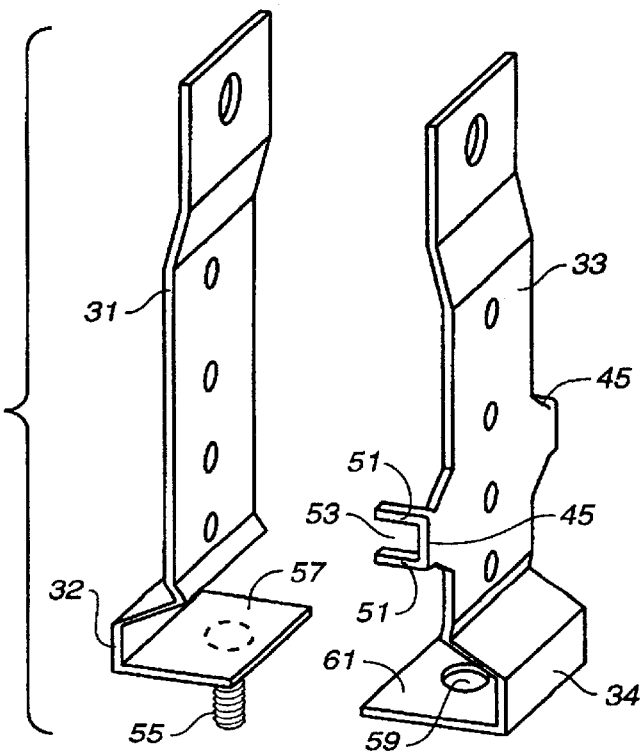
FIG. 2A is a top perspective, exploded view of the body of the hanger bracket of the hanger bracket assembly shown in FIG. 1.

Referring to FIGS. 1–4, a hanger bracket assembly 23 is shown mounted to mounting rail 19 for suspending a lighting fixture (not shown) below ceiling tile 17. The hanger bracket assembly includes hanger bracket 25, an electrical junction box 27 fastened to the front of the hanger bracket by means of screw fasteners 29, and a ceiling canopy 12 which covers the hanger bracket, the electrical feed plug-in connection described below, and the cut-out opening 81 in the ceiling tile. As best illustrated in FIG. 2A, hanger bracket 25 is formed by elongated shaped front and rear hanger strips 31, 33 which are fastened together by the screw fasteners 29 to form an elongated bracket body 35 having a top end 40, a base end 41, and a bowed-out center portion 42. A load wire attachment point for load wires 39 is provided at the top end of the bracket body in the form of a wire hole 37.

Bracket body 35 has two separate attachment structures to permit attachment of the hanger bracket 25 to a grid ceiling system at on and off-grid locations. A first attachment structure is provided at the bracket body's base end 41 in the form of a T-bar channel 43 formed by opposed lower bent sections 32, 34 of the joined hanger strips 31, 33. As hereinafter described, the T-bar channel at the base end of the hanger bracket permits conventional mounting of the hanger bracket to the T-bar members 15, 16 of the ceiling's T-grid. A second attachment structure permits attachment of the hanger bracket to the grid ceiling's optional mounting rail 19. This second attachment structure is provided in the form of rail gripping structures 45 on opposite lateral edges 47, 49 of the center bowed-out portions of rear hanger strip 33. These rail gripping structures include laterally extending tabs 46 having upper and lower forward extending arms 51 which provide forward facing U-shaped grips 53 sized to fit over and capture the mounting rail against the front hanger strip when the front and rear hanger strips are fastened together.

It will be appreciated that the rear hanger strip 33 as well as front hanger strip 31 can be fabricated inexpensively from a stamped metal part which is bent in its desired shape.

The body of the hanger bracket 25 is further seen to have a lighting fixture attachment element in the form of a threaded rod 55 fixed to and projecting from the horizontal bottom wall 57 of the lower bent section 32 of front hanger strip 31. The threaded rod 55 extends through opening 59 in the bottom wall 61 of the lower bent section of rear hanger strip 33 (see FIG. 2A) when the hanger strips are assembled, and provides a threaded attachment for the internally threaded fitting 63 at the attachment end of the lighting fixture's suspension cable 65. The threaded rod 55 will have sufficient length to project through the ceiling tile 17 and a first opening in the canopy 12 which, as hereinafter described, is placed on the bottom side of the ceiling tile when the lighting fixture is hung.

FIGS. 1–4, and FIG. 6, additionally show the unique aspect of the invention wherein a power outlet is provided at the canopy of the hanger assembly so that the electrical feed for the lighting fixture can be plugged in by an installer at a plug connection that is unobtrusive and architecturally acceptable. With respect to this plug in feature, the lighting fixture (not shown) is provided with a power cord 67 of suitable length to reach the ceiling. The male plug 69 at the end of power cord inserts through a suitably sized second opening 75 in the ceiling canopy 12 to engage the plug end 77 of female plug 71 which is connected to bottom wall 73 of the electrical junction box 27 connector 79. The plug end of female plug 71 lies on the inside of the canopy such that the interface between the male and female plugs cannot be seen, and such that, when the male plug is inserted through the second opening in the canopy, a clean and architecturally pleasing transition is provided between the canopy and the plug. The electrified female plug 71 can be wired at the junction box by an electrician before the fixtures are installed, and by providing an array of hanger brackets with wired power outlets above the ceiling at potential power feed locations throughout the grid ceiling system, lighting fixtures can later be moved easily to other points in the power outlet array without the need to rewire.

Figure 3:
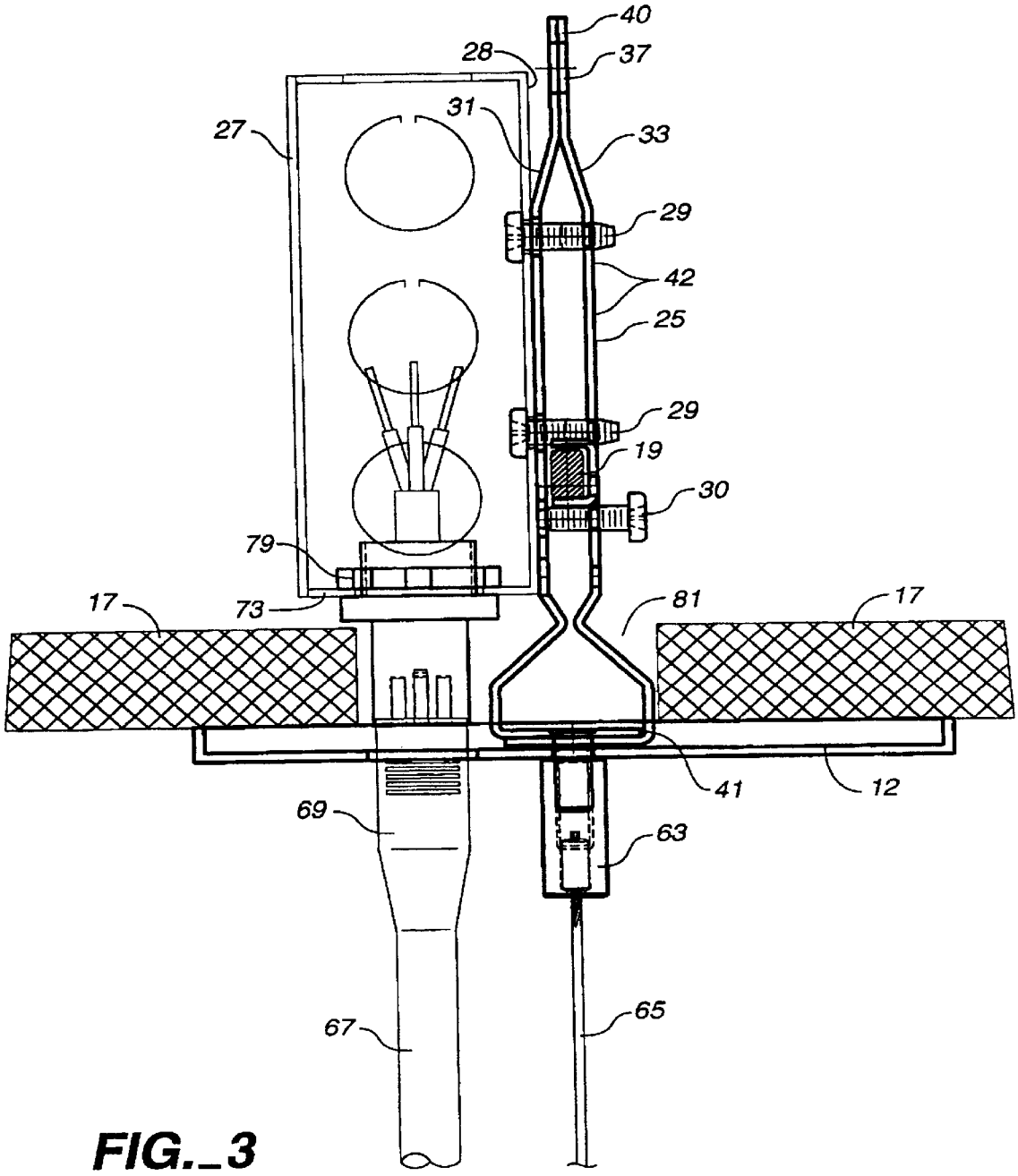
FIG. 3 is a side elevational view of the hanger bracket assembly shown in FIG. 1 with the fixture suspension cable connected to the hanger bracket and with the fixture power cord plugged in at the ceiling canopy.

To install a lighting fixture with an electrical feed using the accessory mounting rail 19 of the grid ceiling system 11 for an off-grid mounting location, the hanger bracket 25 is first loosely installed on mounting rail 19 by assembling the hanger strips 31, 33 over the mounting rail such that the mounting rail is engaged in the U-shaped openings 53 of the rail gripping structures 45 of rear hanger strip 33. The hanger strips, along with junction box 27, are then fastened together by screw fasteners 29 which are inserted through backwall 28 of the junction box. Before tightening the screw fasteners, the hanger bracket and junction box assembly is moved along the rail to its desired position in correspondence with the desired suspension location. By tightening up on screw fasteners 29, the bracket and junction box can be locked into place on the mounting rail and the mounting rail then placed across T-bar members 15 at a lateral position that properly places the hanger within the ceiling grid. As best shown in FIG. 3, with the mounting rail and hanger assembly installed, the base end 41 of hanger bracket 25 along with the female plug 71 connected to junction box 27 will extend into an opening 81 cut into the ceiling tile to accommodate the hanger assembly and plug. Once positioned, load wires 39 are attached to the top end of the hanger bracket and the fixture hung by placing the canopy over cutout opening 81 and screwing the fitting 63 of the fixture's suspension cable 65 onto projecting threaded rod 55 which projects through the canopy. Instead of calling in an electrician to wire the electrical feed to the electrical junction box, the fixture is simply plugged in through the canopy into the electrical outlet provided by female plug 71.

Figure 2:
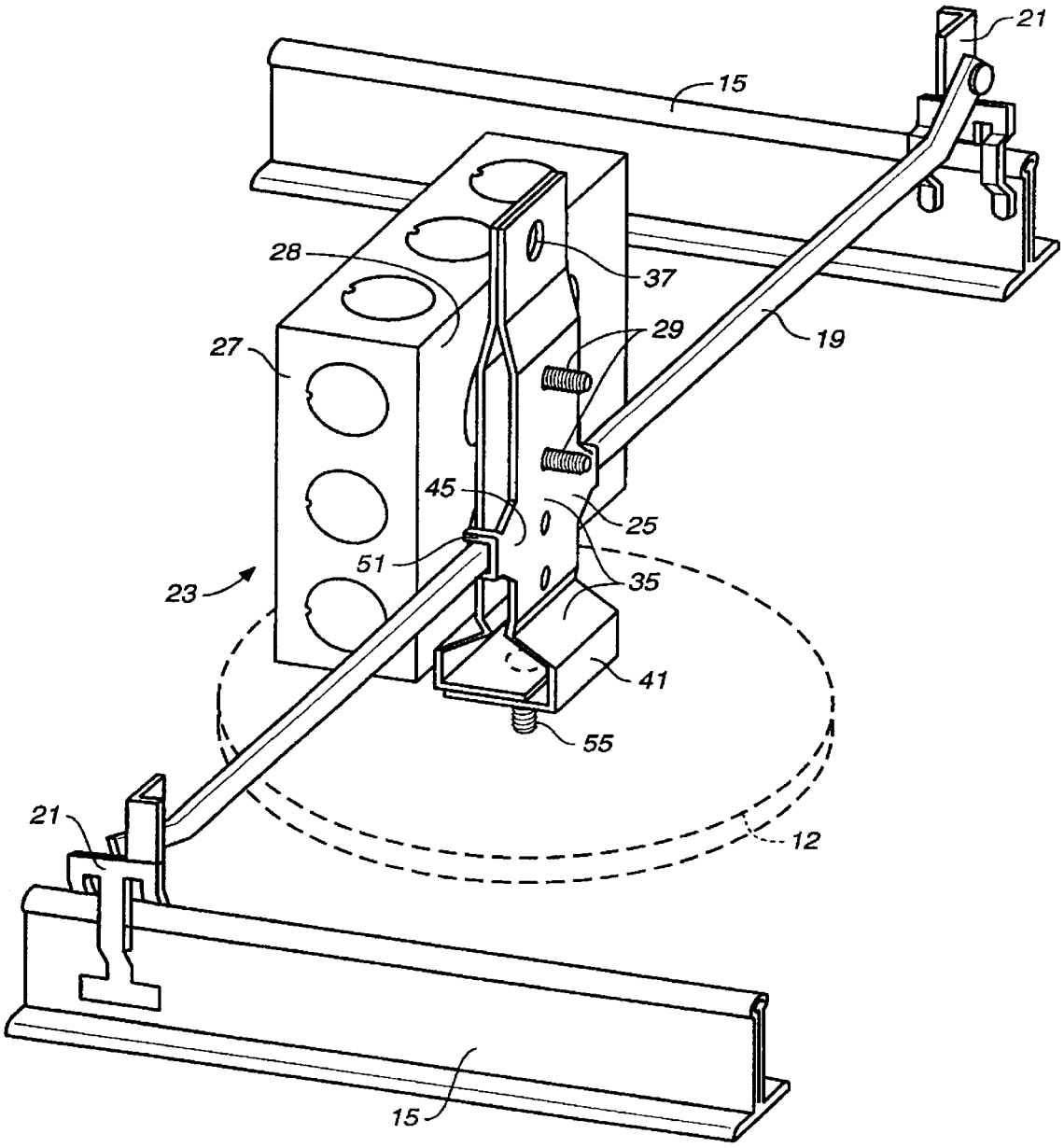
FIG. 2 is an enlarged perspective of the hanger bracket assembly shown in FIG. 1.
Figure 4:
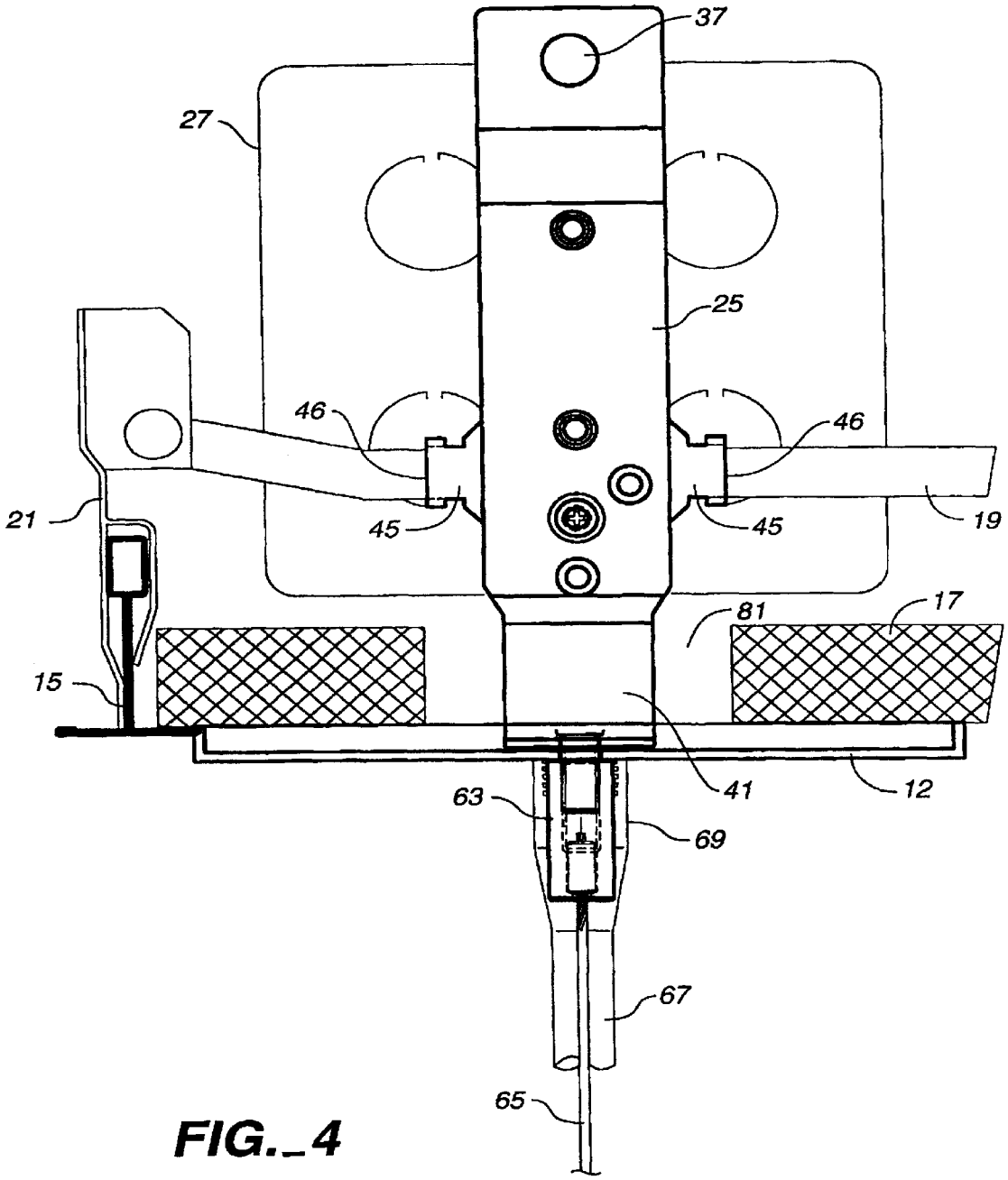
FIG. 4 is a rear elevational view of the hanger bracket assembly as shown in FIG. 3 with the hanger bracket positioned differently on the mounting rail than shown in FIG. 1.
Figure 5:
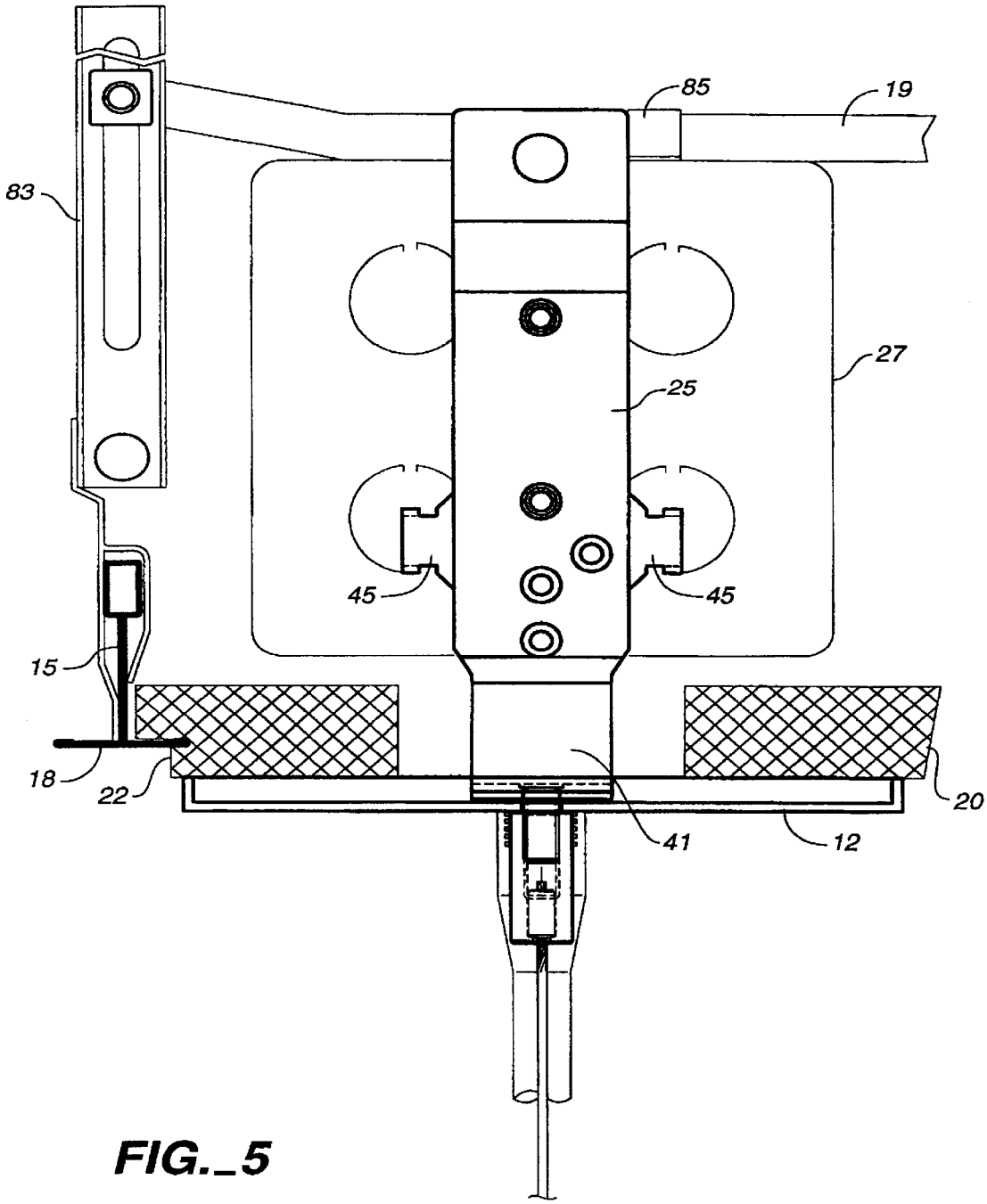
FIG. 5 is a rear elevational view of the hanger bracket assembly shown in FIGS. 1–4 wherein the hanger bracket is mounted to an elevated mounting rail from the junction box of the hanger bracket assembly to accommodate vertical height differences of ceiling tiles relative to their supporting T-grid.
Figure 6:
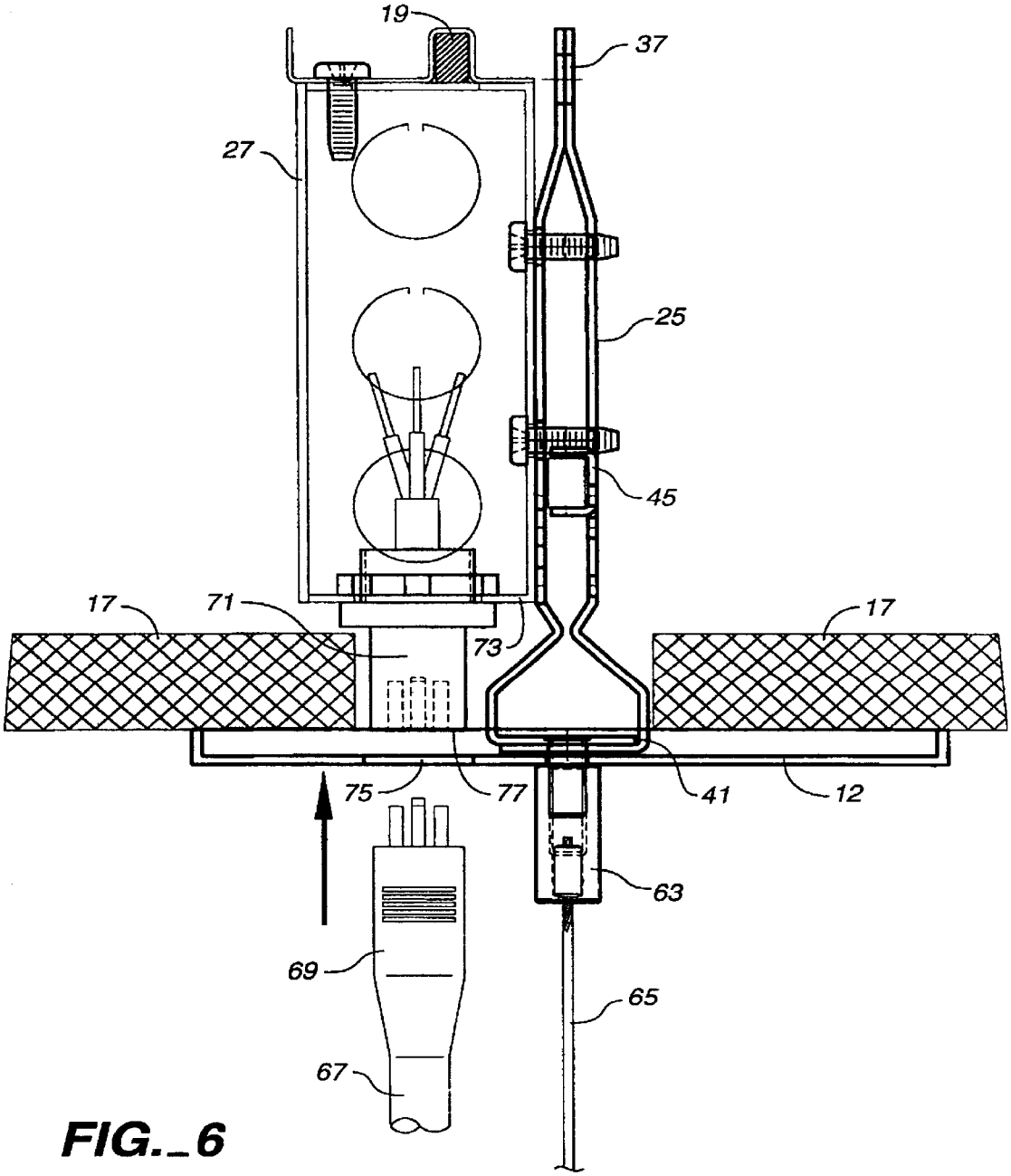
FIG. 6 is a side elevational view thereof, showing the fixture power cord being plugged into the electrical outlet at the ceiling canopy.

FIG. 4 shows a hanger assembly 23 secured to mounting rail 19 at a different position than shown in FIGS. 1–3. In FIG. 4, the hanger system is located on the far end of the mounting rail at a position closer to the T-bar. FIGS. 5 and 6 show an alternative arrangement wherein the hanger bracket assembly 23 is secured to a mounting rail 19 elevated above the T-bars 15 by means of vertically adjustable extension arms 83. Mounting rail clips with vertical adjustments as shown in FIGS. 5 and 6 are commercially available for use with grid ceiling systems where the height of the hanger brackets must be vertically adjusted to account for variations in the design of grid ceiling systems. For example, in FIGS. 5 and 6, it can be seen that the acoustical ceiling tile 20 has recessed kerfed edges 22 as found in some ceiling tile designs. The recessed edges cause the ceiling tile to sit further down on the horizontal ledge 18 of T-bar 15, which means the vertical height of the hanger bracket 25 must be lowered to provide suitable extension of hanger rod 55 and plug 71 relative to the ceiling canopy 12. In FIGS. 5 and 6, this height adjustment is achieved by elevating the mounting rail using commercially available height adjustable mounting bar clips 21a and suspending the mounting bracket from the top wall of the junction box 27 by means of a clip 85 on the top wall of the junction box. By taking advantage of the width of the box, the height of the hanger bracket and plug can be lowered without changing to a different bracket design.

Figure 7:
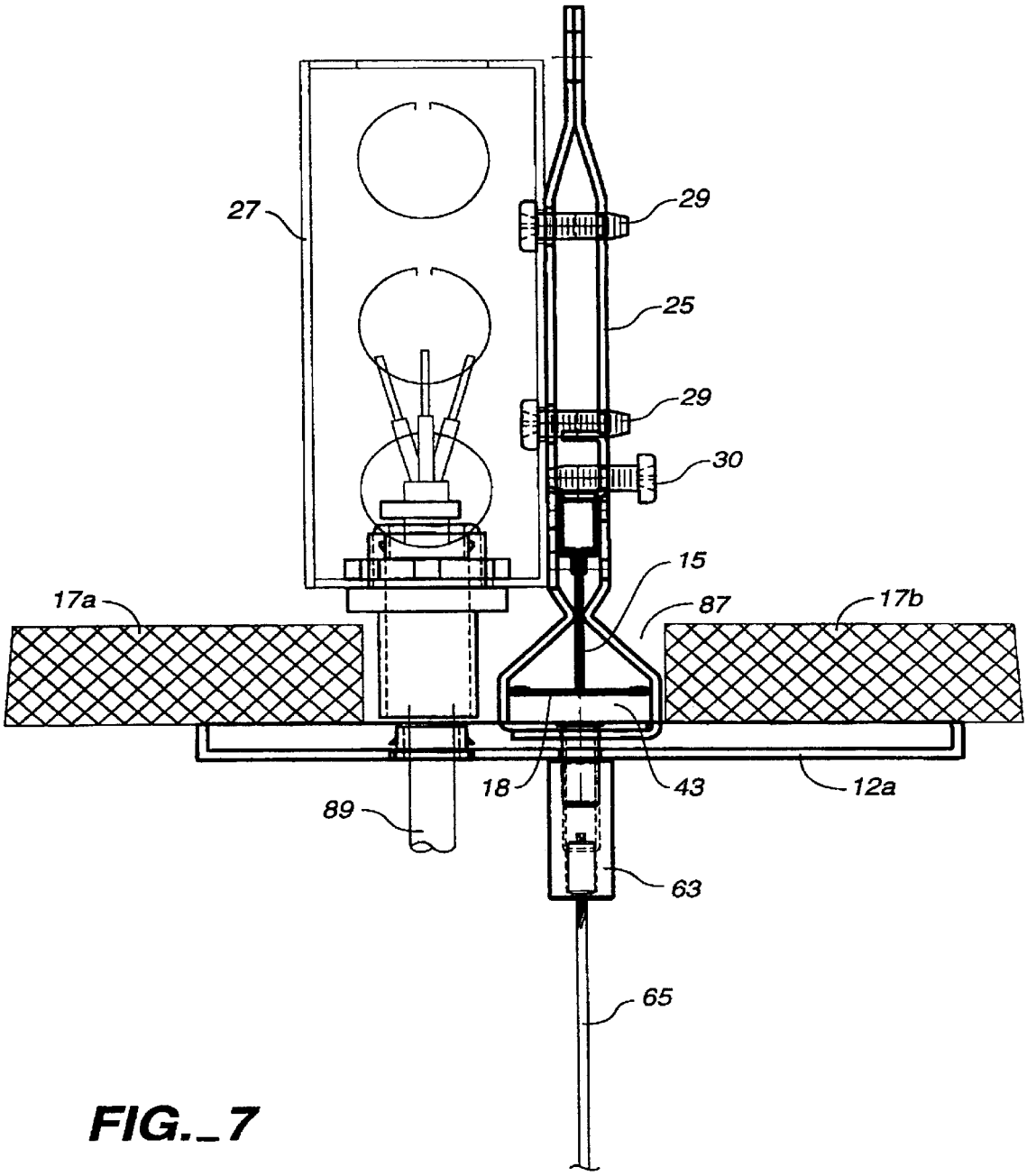
FIG. 7 is a side elevational view of an alternative version of the hanger bracket assembly of the invention, showing the lighting fixture wired directly to the assembly's electrical junction box, and showing the hanger bracket of the hanger bracket assembly secured to a T-bar of the grid ceiling system for positioning the lighting fixture suspension at an on-grid location.
Figure 8:
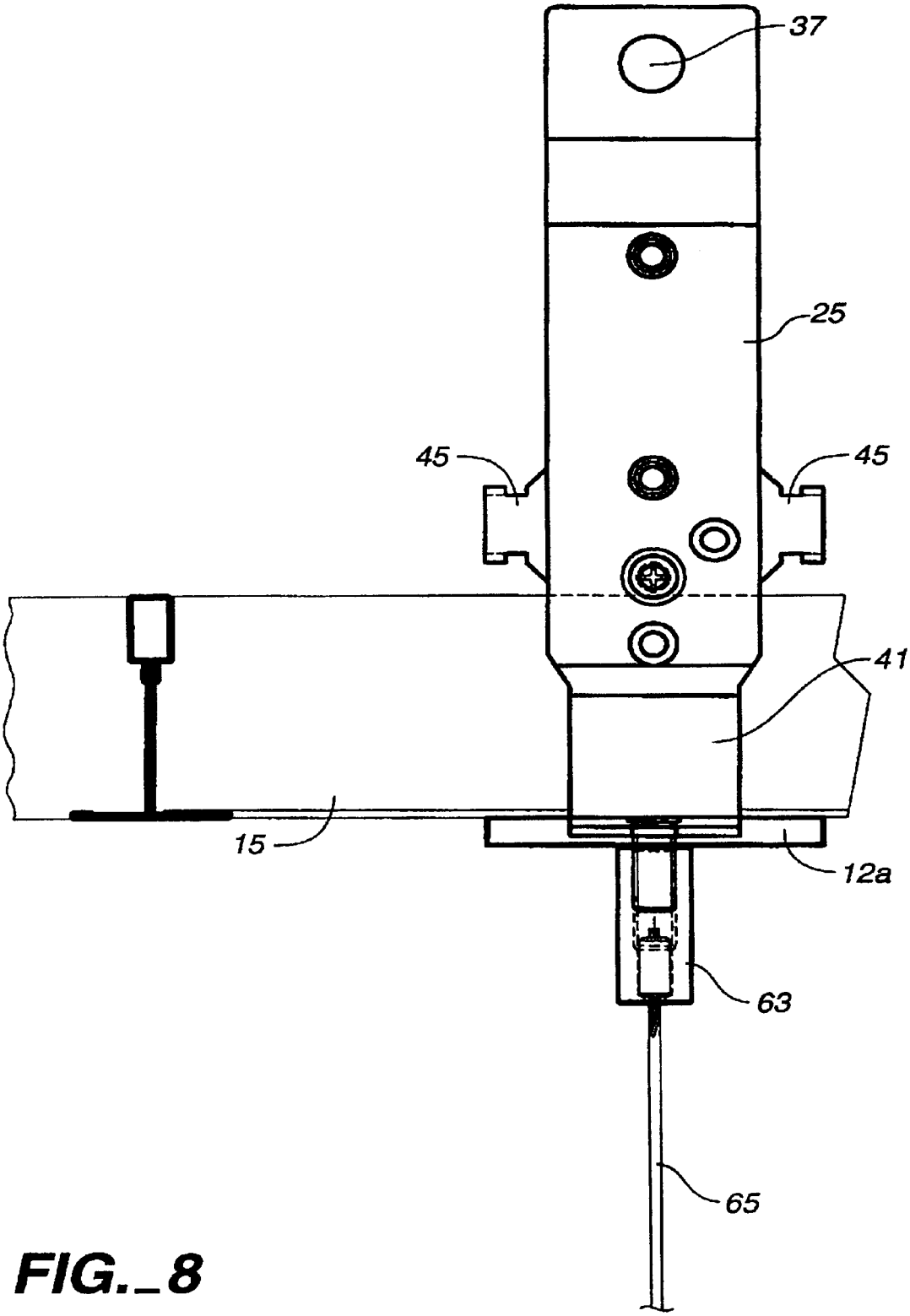
FIG. 8 is a rear elevational view of a hanger bracket in accordance with the invention without an electrical junction box wherein the hanger bracket is secured to the T-bar of the grid ceiling system, and showing the cross-sectional shape of the T-bar to which the hanger bracket is secured.
Figure 9:
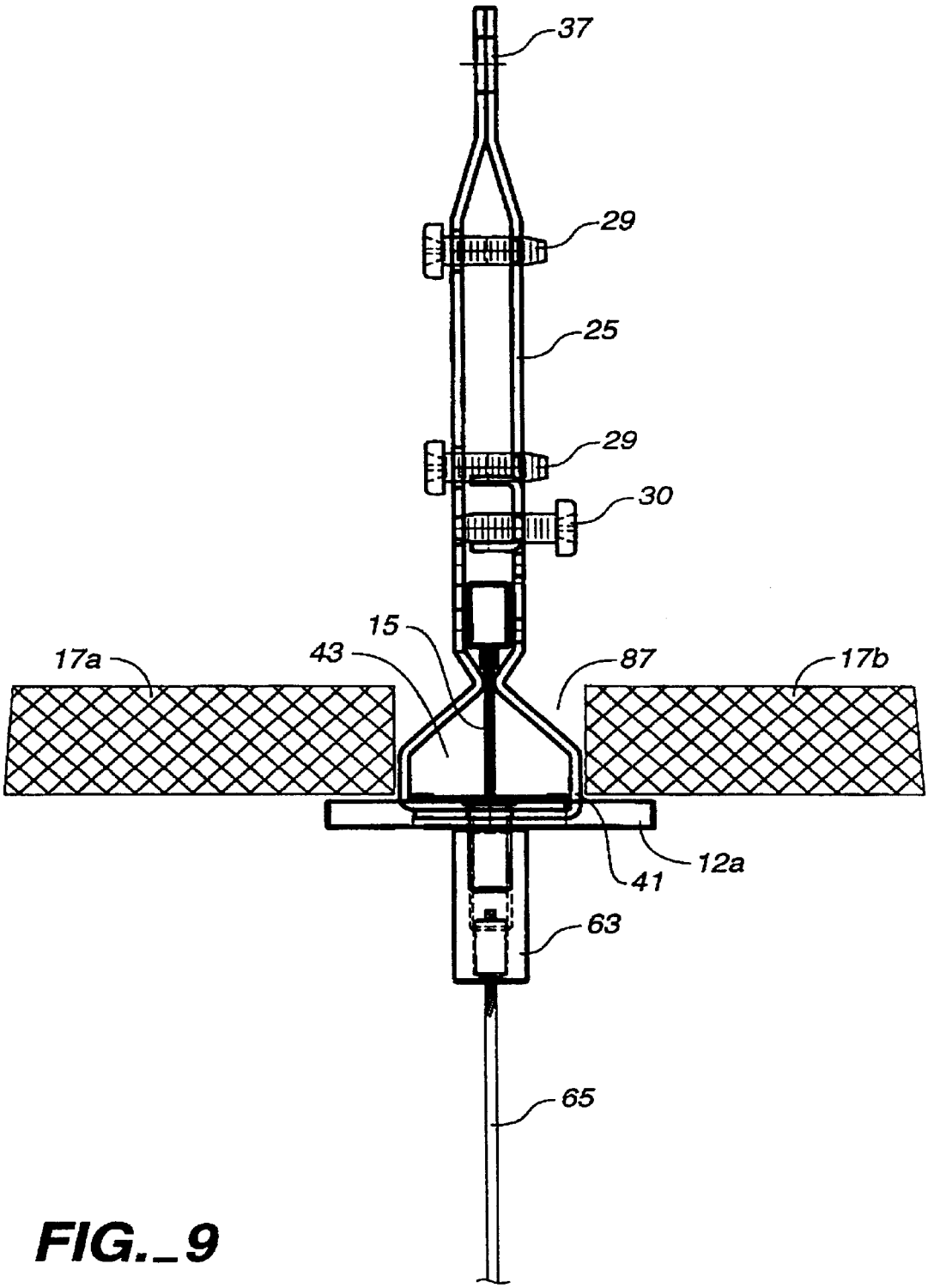
FIG. 9 is a side elevational view thereof.

In the hanging arrangement shown in FIGS. 7–9, the hanger assembly 23 is secured directly to a T-bar member 15 to provide an on-grid suspension location instead of an off-grid location. In these figures, T-bar 15 is engaged within the T-bar channel 43 at the base end of hanger bracket 25. In this position it can be seen that the fixture suspension cable 65 is aligned directly with the T-bar, i.e., the suspension is "on-grid." A suitable opening 87 is cut into adjacent ceiling tiles 17*a*, 17*b* to accommodate the base end of the hanger bracket and the fixture's power cord 89, which for illustrative purposes, is shown in FIG. 7 to be wired directly to the junction box 27 of the hanger assembly. The embodiment illustrated in FIG. 7 could as well be provided with a separate electrical outlet at the canopy 12 as described above wherein the fixture is plugged in at the canopy. It is further noted that the embodiment in FIG. 7 shows the horizontal ledge 18 of T-bar member 15 elevated in T-bar channel 43. Such a position would coincide with the use of ceiling tiles having recessed kerfed edges as shown in FIG. 5.

Figure 10:
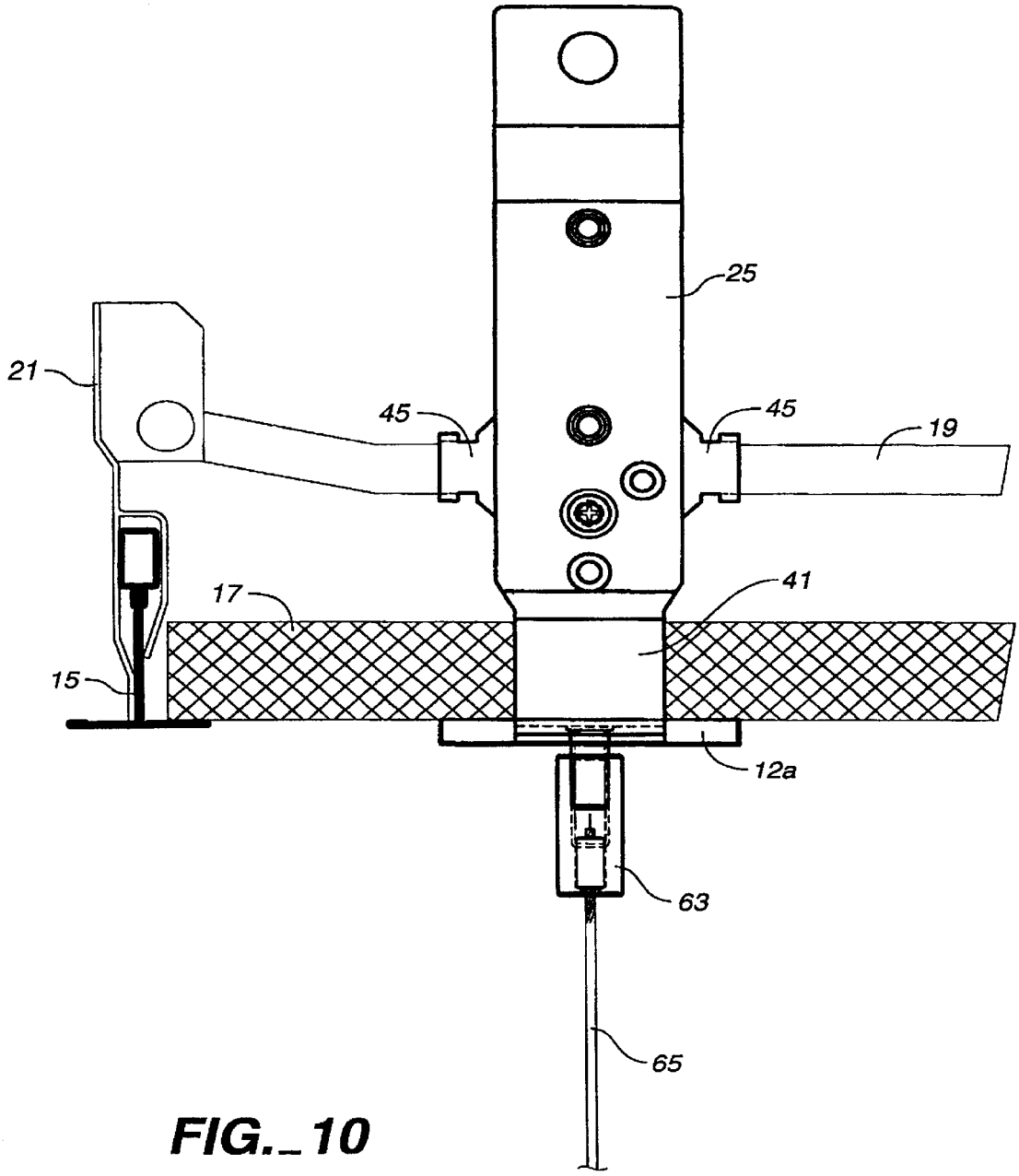
FIG. 10 is a rear elevational view of a hanger bracket in accordance with the invention without an electrical junction box secured to a mounting rail of a grid ceiling system.

FIGS. 8–11 illustrate the use of the hanger bracket of the invention at suspension locations that do not require a separate electrical feed. FIGS. 8 and 9 illustrate use of the hanger bracket for on-grid suspension locations, whereas FIG. 10 show the use of the hanger bracket for suspensions at off-grid locations. In both embodiments, the hanger bracket is used alone without an electrical junction box. More specifically, in FIGS. 8 and 9 hanger bracket 25 is mounted to T-bar 15 such that the T-bar runs through the T-bar channel 43 of the hanger bracket such that the base end of the hanger sets down into opening 87 cut into adjacent tile 17*a*, 17*b*. The hanger bracket is installed by simply assembling the opposed hanger strips 31, 33 around T-bar member 15 at a desired location along the T-bar, and then fastening the hanger strips together by means of screw fasteners 29, 30. It is noted that, in this arrangement, the screw fastener 30 has been added to provide an added clamping force about the T-bar. The canopy 12*a* is then placed over the fixture threaded hanger rod 55 and the fixture suspension cable connected by means of fitting 63 which holds the canopy in place.

Figure 11:
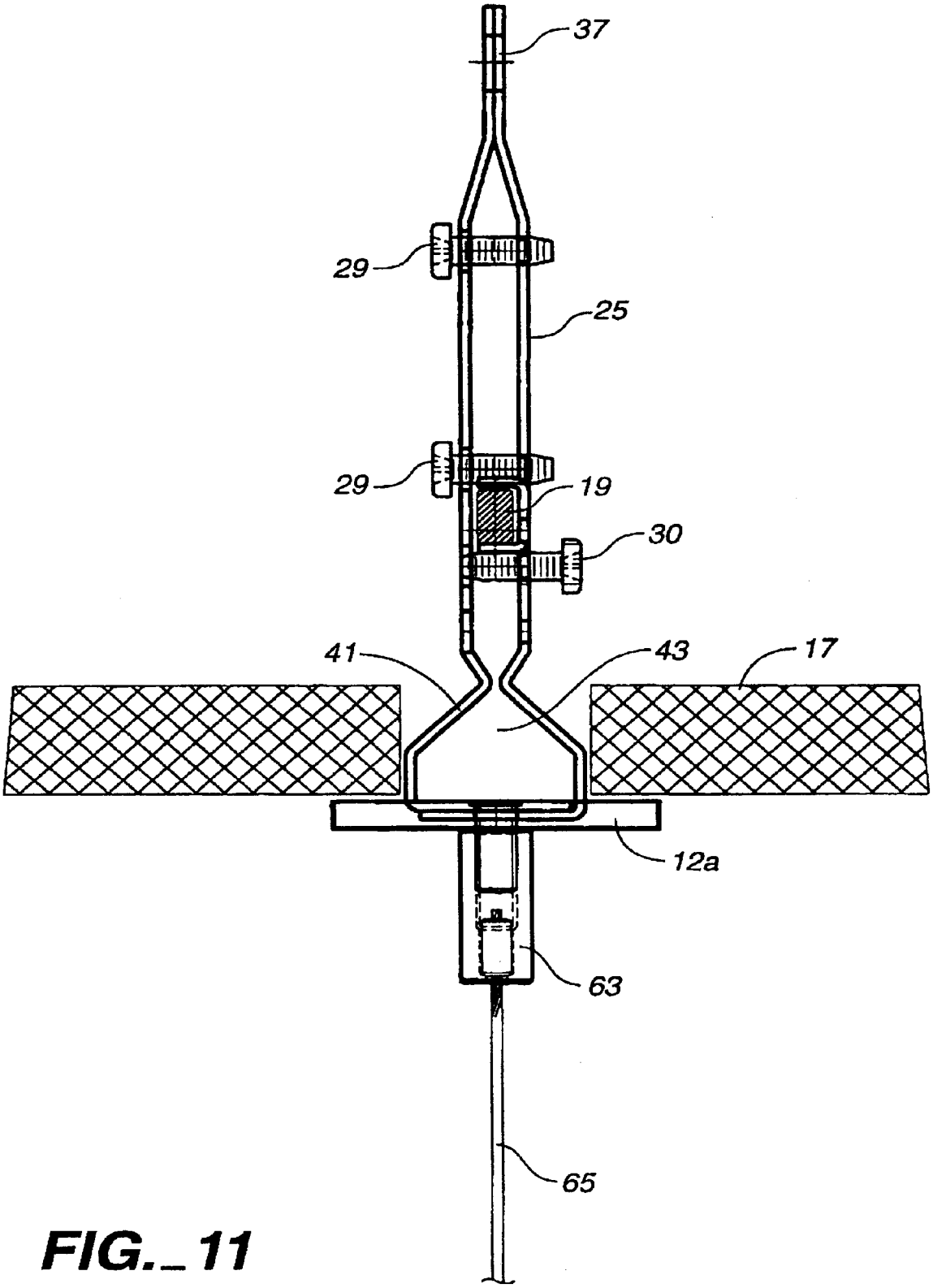
FIG. 11 is a side elevational view thereof.

In FIGS. 10 and 11, hanger bracket 25 is mounted to the accessory mounting rail 19 at a non-feed location which is between supporting T-bar members 15. As in the previously described embodiments, the base end 41 of the hanger bracket extends through ceiling tile 17 to receive canopy 12*a* and the fitting 63 at the end of the fixture's suspension cable 65. Placement of the hanger bracket along the mounting rail 19 can be adjusted to locate the hanger bracket at the desired suspension point.

Figure 12:
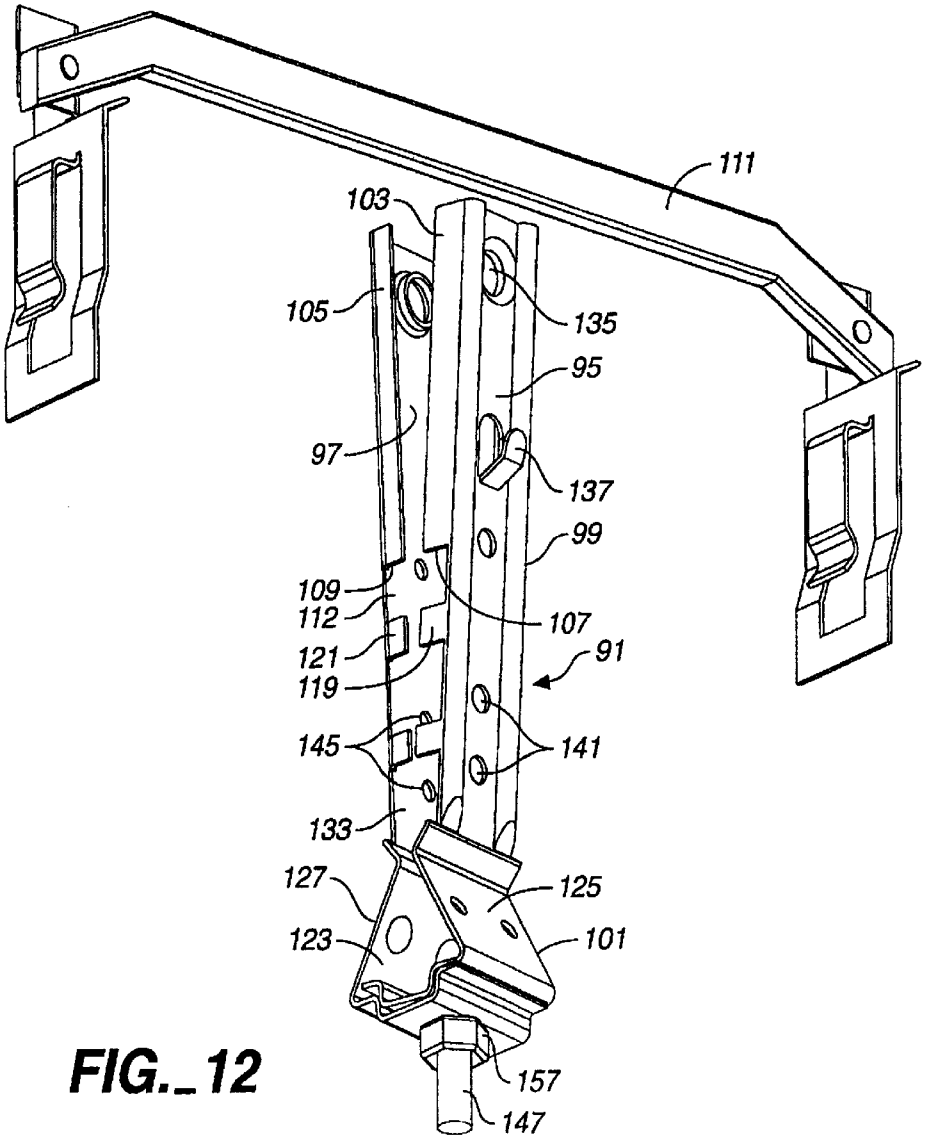
FIG. 12 is a bottom perspective view of an alternative embodiment of a hanger bracket in accordance with the invention showing the hanger bracket positioned for securement to a mounting rail of a grid ceiling system for providing an off-grid suspension point.
Figure 13:
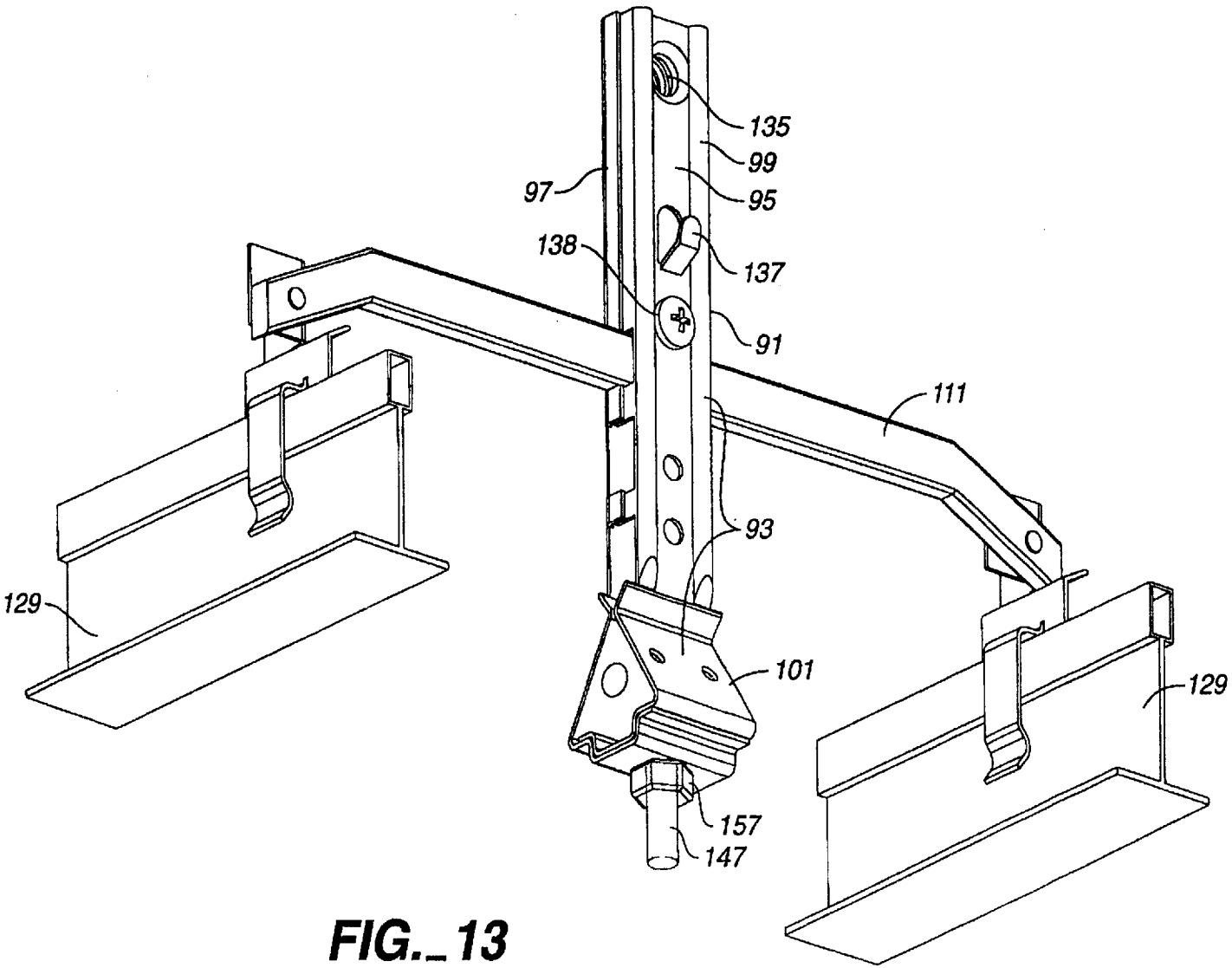
FIG. 13 is a bottom perspective view thereof showing the hanger bracket secured to the mounting rail shown in FIG. 12.

FIGS. 12–16 show an alternative embodiment of the invention wherein the front and rear hanger strips 95, 97 forming the elongated bracket body of hanger bracket 91 each include a straight channel-shaped upper portion 108, 110 having inwardly projecting side walls 103, 105 which overlap when the hanger strips are joined together as shown in FIG. 13. Complimentary upper cut-outs 107, 109 are provided in each of the side walls 103, 105 of hanger strips 95, 97 to form an upper rail gripping channel 112 at each lateral edge of the hanger bracket for gripping a mounting rail of a grid ceiling system as illustrated in FIGS. 12 and 13. Additional lower complimentary cut-outs 113, 114, 117, 118, separated by tabs 120, 122, are provided in each hanger strip side wall to accommodate T-bars of different sizes as described below.

Figure 15:
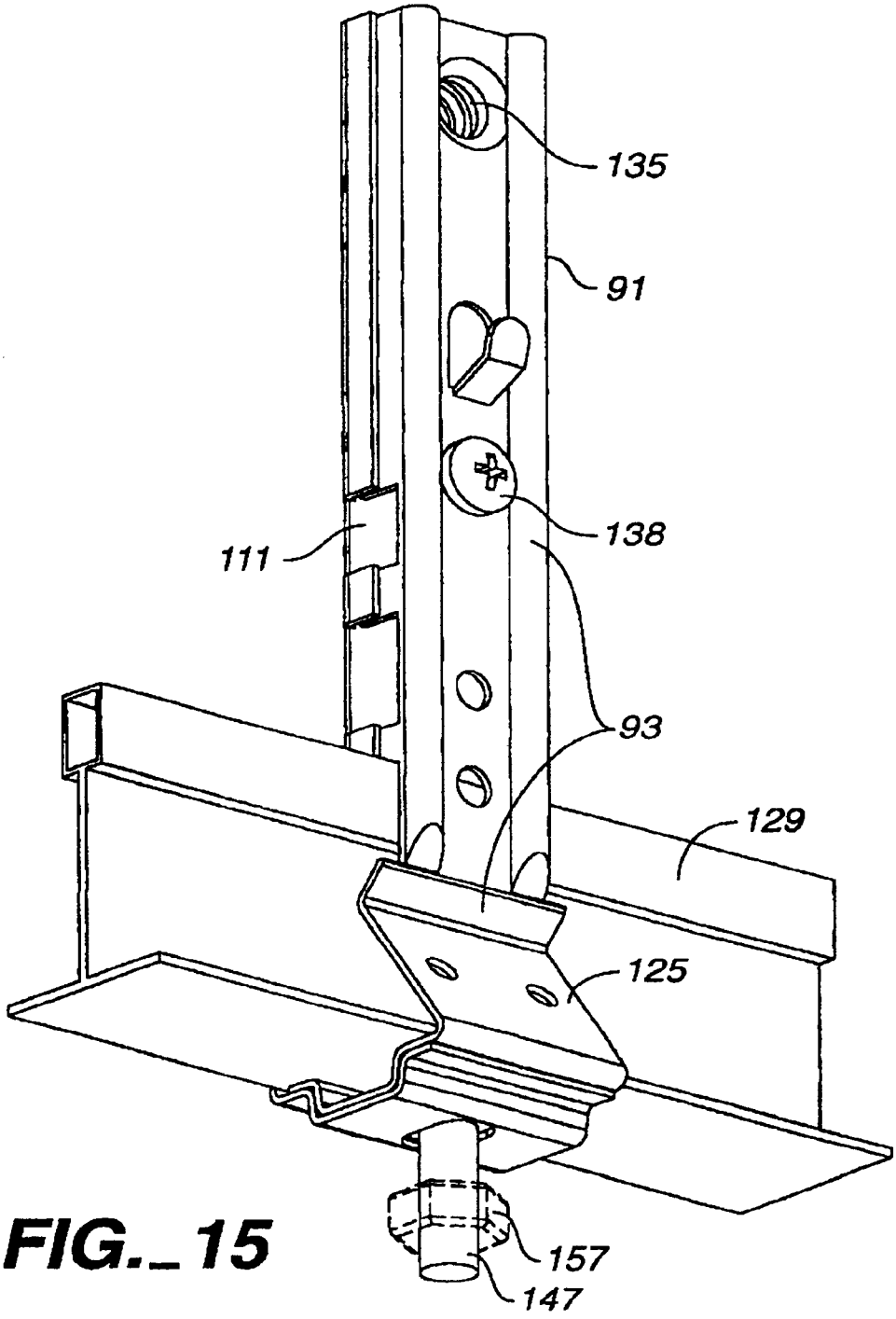
FIG. 15 is a bottom perspective view thereof showing the hanger bracket secured to the T-bar of the grid ceiling system shown in FIG. 14.

The base end 101 of hanger bracket body 93 is shaped to fit over a T-bar of a grid ceiling system in a manner similar to that shown and described in connection with the embodiment of the invention illustrated in FIGS. 1–11. Specifically, the base end of the bracket body has a T-bar channel 123 formed by opposed lower bent sections 125, 127 of the hanger strips 95, 97 to permit the hanger bracket to be positionably mounted to a grid ceiling's T-bar member 129. As best shown in FIG. 15, the lower portion of T-bar 129 fits into T-bar channel 123 while the top box-shaped end of the T-bar fits through the bottom cut-out opening 133 formed by hanger strip cutouts 117, 118.

It is seen that the top end of hanger bracket body 93 also includes a wire hole 135 for receiving load wires (not shown) from the overhead ceiling structure. A L-shaped punch-out tab is further provided on the front face of front hanger strip 95 to facilitate attachment of an electrical junction box to the front of the hanger bracket as hereinafter described. In this embodiment of the hanger bracket, a lighting fixture attachment element is also provided in the form of a separate fixture attachment bolt 147 (suitably a ¾ to one inch 1/4-20 bolt), the threaded end of which is insertable through bolt hole 149 in the bottom wall of the lower bent section 125 of front hanger strip 95. It can be seen that bottom wall 151 of this lower bent section 125 is cupped to accommodate the bolt head 148.

Thus, like the earlier described embodiment, the embodiment of the invention illustrated in FIGS. 12–16 provides in the same hanger bracket two attachment structures for alternatively attaching the hanger bracket to a grid ceiling system at an on-grid or off-grid location. These two attachment structures include a first attachment structure comprised of the lower bent sections 125, 127 of the hanger strips and a separate attachment bolt 147, and a second attachment structure comprised of mounting bar channels formed by the cut-outs 107, 109 in the side walls of the top portion of the hanger strips.

The hanger bracket illustrated in FIGS. 12–16 is installed at an on or off-grid location of a grid ceiling system in a manner similar to that described in connection with the hanger bracket illustrated in FIGS. 1–11. To secure hanger bracket 91 to a mounting rail of the grid ceiling system, that is, at an off-grid location, the front and rear hanger strips 95, 97 are simply fitted together over the mounting rail 111 as shown in FIGS. 12 and 13 such that the mounting rail is captured in the rail gripping channels 112 formed by the joined hanger strips. At least one screw fastener, such as screw fastener 138, screws into one or more suitable fastener openings 139, 141, 143, 145, in the front and rear hanger strips to hold the hanger strips tightly together on the mounting rail.

Figure 14:
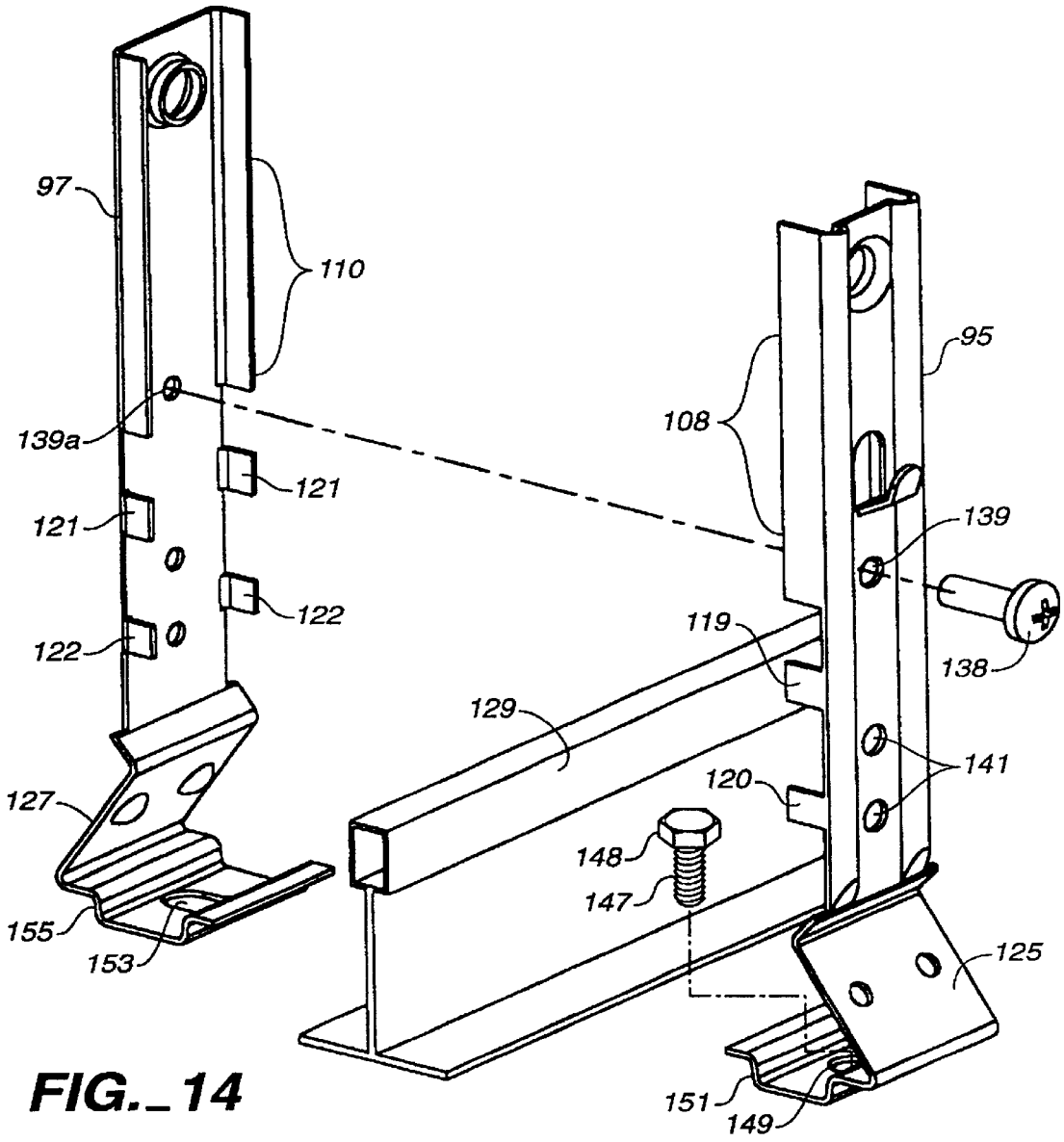
FIG. 14 is a top perspective view of the hanger bracket shown in FIGS. 12 and 13 positioned for mounting the hanger bracket directly to a T-bar of a grid ceiling system.

To install the hanger strips on a T-bar as shown in FIGS. 14 and 15, the lower bent section 125 of the front hanger strip is first fitted under the T-bar with the fixture attachment bolt 147 in place in bolt hole 149. The rear hanger strip 97 is then placed in opposition to the front hanger strip by hooking the lower bent section 127 of the rear hanger strip under the lower bent section 125 of the front hanger strip such that the threaded end of the fixture attachment bolt 147 projects through bolt hole 149 in the bottom wall 151 of the rear hanger strip's lower bent section. The two hanger strips are then fastened together by means of screw fastener 138. In the case of oversized T-bars, tabs 120, 122 on the hanger strips can be folded back to prevent interference between the tabs and the T-bar.

It is noted that special ceiling systems may require that spacers, such as hexnut 157, be used on the fixture attachment bolt 147 where it projects from the base end of the hanger bracket.

Figure 16:
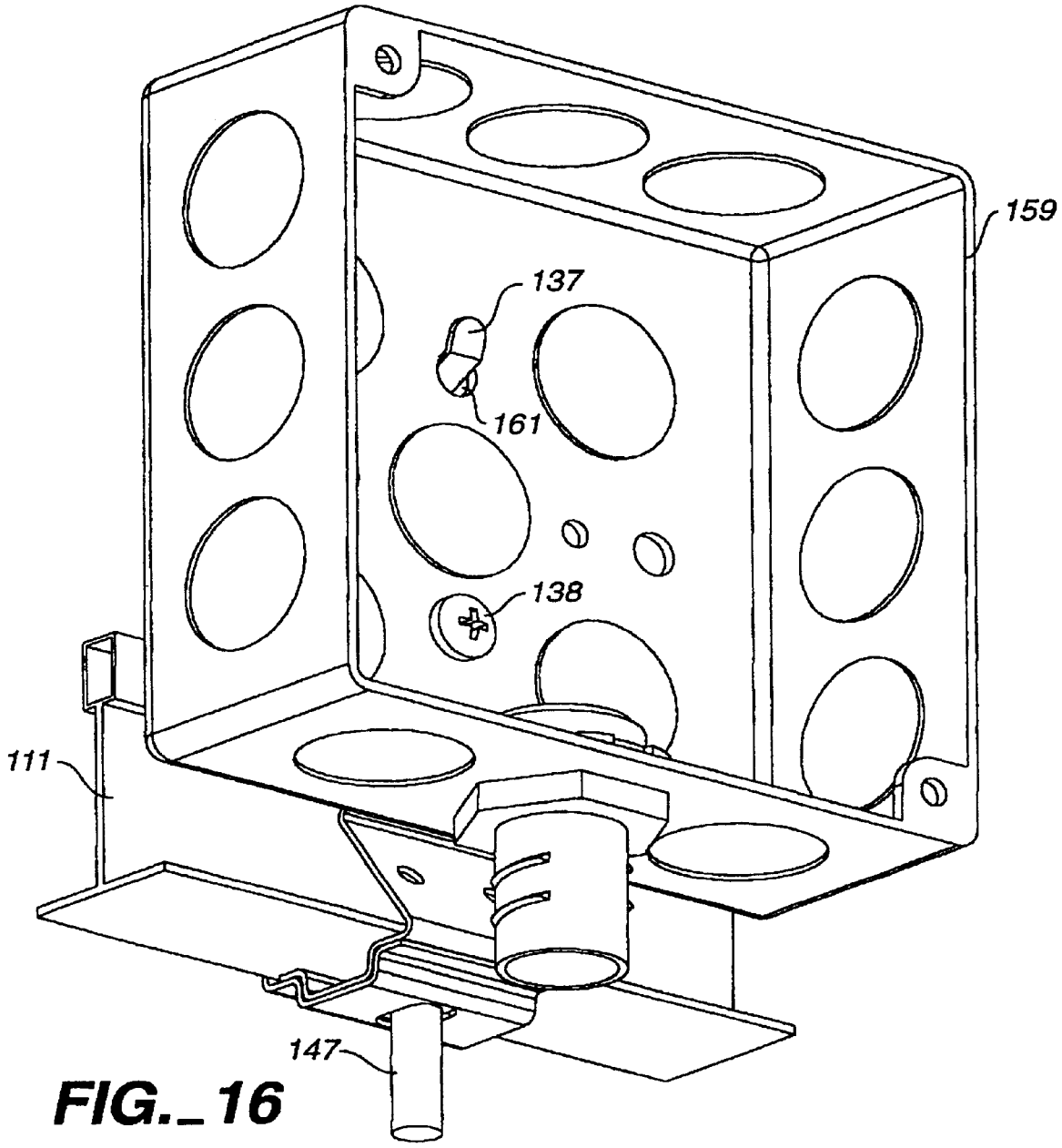
FIG. 16 is a bottom perspective view of the hanger bracket mounted to the T-bar of a grid ceiling system as shown in FIG. 15 with an electrical junction box secured to the hanger bracket.

As shown in FIG. 16, an electrical junction box 159 can be readily attached to this illustrated hanger bracket after it is secured to the grid ceiling system at either an on-grid or off-grid location. This is achieved by simply hooking projecting tab 137 on the bracket's front hanger strip 95 through a top opening 161 in the backwall of the junction box, and then fastening the junction box and two hanger strips together by means of screw fastener 138. Fastener openings 141, 145 on the hanger strips are provided at suitable spacings to register with screw holes found on standard junction box designs.

Attachment of a ceiling canopy, lighting fixture suspension wires, and load wires to the embodiment of the hanger bracket illustrated in FIGS. 12–16 are accomplished in the same manner as described in connection with the earlier described embodiment of the invention.

While the present invention has been described in considerable detail in the foregoing specification, it will be understood that it is not intended that the invention be limited to such detail, except as necessitated by the following claims.

What we claim is:

1. A load-bearing hanger bracket for suspending a lighting fixture from on-grid and off-grid locations within a grid ceiling system having a T-bar grid formed by connected T-bar members to which accessory mounting rails can optionally be attached and having ceiling tiles supported by the T-bar grid, said hanger bracket comprising an elongated baracket body having a base end, a top end, a top end, and at least one load wire attachment point, a lighting fixture attachment at the base end of said bracket body, a first attachment structure at the base end of said bracket body for attaching the hanger bracket to a T-bar member of a grid ceiling system at a selected location along said T-bar member, and a second attachment structure on said bracket body above said first attachment structure for attaching the hanger bracket to an accessory mounting rail connected between opposed T-bar of the grid ceiling system at a selected location along the mounting rail, whereby the hanger bracket can be used to hang a lighting fixture from a T-bar member of the ceiling grid or from a mounting rail attached between T-bar members in order to place the lighting fixture at desired locations within the grid ceiling system.

2. The hanger bracket of claim 1 wherein the second attachment structure is located between the top and base ends of the bracket body.

3. The hanger bracket of claim 1 wherein said bracket body has lateral edge portions and said second attachment structure includes a rail-gripping structure at each lateral edge of said bracket body for gripping a mounting rail of a grid ceiling system.

4. The hanger bracket of claim 1 wherein said bracket body is comprised of two opposed hanger strips having opposed lower bent sections forming a T-bar channel for capturing a T-bar member of a grid ceiling system thereby providing a first attachment structure and is further comprised of fastening means for joining said opposed hanger strips together, and wherein said second attachment structure is provided on at least one of the hanger strips forming said bracket body.

5. A load-bearing hanger bracket for suspending a lighting fixture from on-grid and off-grid locations within a grid ceiling system having a T-bar grid formed by connected T-bar members to which accessory mounting rails can optionally be attached and having ceiling tiles supported by the T-bar grid, said hanger bracket comprising two opposed elongated hanger strips having opposed lower bent sections which when joined together form a T-bar channel for capturing a T-bar member of a grid ceiling system thereby providing a first attachment structure for attaching the hanger bracket to a T-bar, at least one fastener for joining said opposed hanger strips together to form an elongated bracket body having a base end, a top end, lateral edges, and at least one load wire attachment point at said top end, a lighting fixture attachment element projecting from the base end of said bracket body, and a rail gripping structure on at least one lateral edge of at least one of the hanger strips of said bracket body for gripping a mounting rail of a grid ceiling system, said rail gripping structure forming a second attachment structure on said bracket body for attaching the hanger bracket to a mounting rail connected between T-bars of the grid ceiling system at a selected location along the mounting rail, whereby the hanger bracket can be used to hang a lighting fixture from a T-bar member of the ceiling grid or from a mounting rail attached between T-bar members in order to place the lighting fixture at desired on-grid or off-grid locations within the grid ceiling system.

6. The hanger bracket of claim 5 wherein each of said rail gripping structures is in the form of forward facing U-shaped grips on opposite lateral edges of one of said hanger strips, said U-shaped grips being sized to fit over a mounting rail of a grid ceiling system.

7. The hanger bracket of claim 6 wherein said gripping structure is formed by a tab laterally extending from each lateral edge of one of said hanger strips, said tab having upper and lower forward extending arms which form said forward facing U-shaped grips.

8. The hanger bracket of claim 5 wherein said hanger strips each include an upper channel shaped portion having inwardly extending sidewalls which overlap when the hanger strips are joined together, and wherein said rail gripping structure is provided by complimentary cut-outs in the sidewalls of said hanger strips which form a rail gripping channel in the bracket body of the hanger bracket.

9. A load-bearing hanger bracket assembly for suspending a lighting fixture with an electrical feed from on-grid and off-grid locations within a grid ceiling system having a T-bar grid formed by connected T-bar members to which accessory mounting rails can optionally be attached and having ceiling tiles supported by the T-bar grid, said hanger bracket assembly comprising an elongated bracket body having a base end, a top end, and at least one load wire attachment point, an electrical junction box attached to the said bracket body, a lighting fixture attachment element projecting from the base end of said bracket body, a first attachment structure at the base end of said bracket body for attaching the hanger bracket assembly to a T-bar member of a grid ceiling at a selected location along said T-bar member, and a second attachment structure on said bracket body above said first attachment structure for attaching the hanger bracket assembly to a mounting rail connected between T-bars of the grid ceiling system at a selected location along the mounting rail, whereby the hanger bracket assembly can be used to hang a lighting fixture from a T-bar member of the ceiling grid or from a mounting rail attached between T-bar members in order to place the lighting fixture and an electrical feed thereto through said junction box at desired on-grid and off-grid locations within the grid ceiling system.

10. The load-bearing hanger bracket assembly of claim 9 wherein said junction box has a bottom wall and wherein the hanger bracket assembly further comprises a female plug connected to the bottom wall of said junction box, said female plug having a downwardly facing plug end for receiving a male plug of a power cord of a lighting fixture suspended from the hanger bracket assembly.

11. The load-bearing hanger bracket assembly of claim 10 further comprising a canopy for covering a ceiling tile of the grid ceiling system at the location of the hanger bracket assembly, said canopy having a first opening for permitting the lighting fixture attachment element of the bracket body to project therethrough, and a second opening sized to permit the male plug of a lighting fixture power cord to plug into the plug end of the female plug connected to said junction box next to the point of suspension of the lighting fixture.

12. The hanger bracket assembly of claim 9 wherein the bracket body of said hanger bracket assembly has lateral edge portions and wherein said second attachment structure includes a rail gripping structure on each lateral edge portion of said bracket body for gripping a mounting rail of a grid ceiling system.

13. The hanger bracket assembly of claim 12 wherein said bracket body is comprised of two opposed hanger strips having shaped base ends for capturing a T-bar member of a grid ceiling system thereby providing a first attachment structure, and is further comprised of fastening means for joining said opposed hanger strips together and wherein said second attachment structure is provided on at least one of the hanger strips forming said bracket body.

14. A hanger bracket assembly for suspending a lighting fixture with a plug-in electrical feed from a grid ceiling system having a T-bar grid formed by connected T-bar members, said hanger bracket assembly comprising a bracket body having a base end and at least one load wire attachment point, an electrical junction box attached to the bracket body, said electrical junction box having a bottom wall proximate to the base end of said bracket body, a female plug connected to the bottom wall of said junction box, said female plug having a downwardly facing plug end for receiving a male plug of a power cord of a lighting fixture suspended from the hanger bracket assembly, a lighting fixture attachment element projecting from the base end of said bracket body, and an attachment structure on said bracket body for attaching the hanger bracket assembly to a grid ceiling.

15. The hanger bracket assembly of claim 14 further comprising a canopy for covering a ceiling tile of the grid ceiling system at the location of the hanger bracket assembly, said canopy having a first opening for permitting the lighting fixture attachment element of the bracket body to project therethrough, and a second opening sized to permit the male plug of a lighting fixture power cord to plug into the plug end of the female plug connected to said junction box next to the point of suspension of the lighting fixture.

16. A method of electrically connecting lighting fixtures to a drop ceiling comprising providing electrical outlets at pre-selected lighting fixture suspension locations above the drop ceiling wherein each of said electrical outlets has a female plug having a downwardly facing plug end extending through the drop ceiling next to a suspension location for the lighting fixtures, wiring the electrical outlets so as to electrify same, hanging lighting fixtures from the drop ceiling having power cords with a male plug end of sufficient length to reach the ceiling, and plugging the male end of the power cords of the lighting fixtures into the female plugs of the prewired electrical outlets above the drop ceiling next to a suspension location of the lighting fixtures.

17. The method of claim 16 wherein a canopy is placed over the suspension location of each lighting fixture having an electrical outlet for providing a clean interface between the ceiling and the lighting fixture suspension and electrical connection, said canopy having an opening for receiving the male plug of the fixture's power cord.

18. The method of claim 17 wherein an array of pre-wired electrical outlets is provided above said drop ceiling to permit lighting fixtures to be moved to different locations on the ceiling without the need to rewire.

* * * * *

UNITED STATES PATENT AND TRADEMARK OFFICE

CERTIFICATE OF CORRECTION

PATENT NO. : 6,345,800 B1 
DATED : February 12, 2002
INVENTOR(S) : Douglas J. Herst and Michael Tran It is certified that error appears in the above-identified patent and that said Letters Patent is hereby corrected as shown below:

Column 9,
Line 20, “baracket” should read -- bracket --.
Line 21, please delete “a top end,” betweeen “end,” and “and”.
Line 31, “T-bar” should read -- T-bars --.

Column 11,
Line 25, please add a -- , -- between the words “together” and “and”.

Signed and Sealed this

Twenty-first Day of June, 2005

JON W. DUDAS
*Director of the United States Patent and Trademark Office*